US009603464B2

(12) United States Patent
Sclare et al.

(10) Patent No.: US 9,603,464 B2
(45) Date of Patent: Mar. 28, 2017

(54) BOOSTER SEAT WITH STOWABLE TRAY AND/OR STOWABLE SECURING STRAP

(71) Applicant: KIDS II, INC., Atlanta, GA (US)

(72) Inventors: Jacob Sclare, Dacula, GA (US); John M. Thomson, Johns Creek, GA (US); Cary Costello, Atlanta, GA (US); Patrick B. Nolan, Royersford, PA (US); Michael A. Dotsey, Pottstown, PA (US); Noah E. Dingler, Phoenixville, PA (US)

( * ) Notice: Subject to any disclaimer, the term of this patent is extended or adjusted under 35 U.S.C. 154(b) by 87 days.

(21) Appl. No.: 14/301,891

(22) Filed: Jun. 11, 2014

(65) Prior Publication Data

US 2014/0368004 A1 Dec. 18, 2014

Related U.S. Application Data

(60) Provisional application No. 61/845,426, filed on Jul. 12, 2013, provisional application No. 61/834,487, filed on Jun. 13, 2013.

(51) Int. Cl.

| | |
|---|---|
| ***A47D 1/00*** | (2006.01) |
| ***A47C 7/62*** | (2006.01) |
| ***A47D 1/10*** | (2006.01) |

(52) U.S. Cl.

CPC ..... *A47D 1/008* (2013.01); *A47D 1/10* (2013.01); *A47D 1/103* (2013.01); *A47D 1/106* (2013.01)

(58) Field of Classification Search

CPC ..... A47D 1/008; A47D 1/10; A47D 1/103
USPC ..... 297/148, 150, 154, 146
See application file for complete search history.

(56) References Cited

U.S. PATENT DOCUMENTS

| | | | | |
|---|---|---|---|---|
| 3,516,709 A * | 6/1970 | Nader | ..... | A47C 1/02 297/153 |
| 3,788,699 A | 1/1974 | Starr | | |
| 4,291,915 A * | 9/1981 | Cox | ..... | B60N 2/2866 190/8 |
| 4,650,246 A | 3/1987 | Henriksson | | |

(Continued)

FOREIGN PATENT DOCUMENTS

EP 0781686 A2 7/1997

OTHER PUBLICATIONS

Britax Infant Positioning Insert; 1 pg.

(Continued)

*Primary Examiner* — David R Dunn
*Assistant Examiner* — Tania Abraham
(74) *Attorney, Agent, or Firm* — Gardner Groff Greenwald & Villanueva, PC

(57) ABSTRACT

A booster seat includes a storage compartment for a tray and/or a storage compartment for securing straps. The tray-storage compartment can be formed in a base of the seat and include an access opening through a sidewall of the base. The tray-storage compartment can include two opposite and inwardly-extending lips that support the tray in the stowed position, and a support foot that moves between a use position in the compartment where it helps support the seat and a stored position displaced from the compartment. Also, the tray-storage compartment can include ribs that engage the tray in the stowed position to retain it there. The strap-storage compartment can be formed in the base and include an access opening with a closure for retaining the straps in the compartment.

18 Claims, 11 Drawing Sheets

(56) References Cited

U.S. PATENT DOCUMENTS

| | | | | |
|---|---|---|---|---|
| 4,695,092 | A | 9/1987 | Hittie | |
| 4,712,833 | A | 12/1987 | Swanson | |
| 4,765,685 | A | 8/1988 | Sudoh et al. | |
| 4,826,208 | A | 5/1989 | Ozmar | |
| 4,854,638 | A | 8/1989 | Marcus et al. | |
| 4,861,109 | A | 8/1989 | Leach | |
| 4,871,210 | A | 10/1989 | Alexander et al. | |
| 4,872,725 | A | 10/1989 | Hakeem | |
| 4,889,388 | A | 12/1989 | Hime | |
| 4,971,392 | A | 11/1990 | Young | |
| 4,980,397 | A | 12/1990 | Rao et al. | |
| 5,071,192 | A | 12/1991 | Adler | |
| 5,095,567 | A | 3/1992 | Kenoyer | |
| 5,183,311 | A | 2/1993 | Meeker et al. | |
| 5,261,134 | A | 11/1993 | Matthews | |
| 5,332,292 | A | 7/1994 | Price et al. | |
| 5,339,472 | A | 8/1994 | Yin | |
| 5,345,633 | A | 9/1994 | Harnish | |
| 5,468,043 | A | 11/1995 | Chien | |
| 5,474,355 | A | 12/1995 | Lerner et al. | |
| 5,519,906 | A | 5/1996 | Fanto-Chan | |
| 5,524,957 | A * | 6/1996 | Gibriano | A47C 7/70 108/26 |
| 5,581,833 | A | 12/1996 | Zenoff | |
| 5,661,861 | A | 9/1997 | Matthews | |
| 5,732,999 | A | 3/1998 | Petrie | |
| 5,800,020 | A | 9/1998 | Brock | |
| 5,813,066 | A | 9/1998 | Gebhard et al. | |
| 5,826,287 | A | 10/1998 | Tandrup | |
| 5,829,830 | A | 11/1998 | Maloney | |
| 5,916,089 | A | 6/1999 | Ive | |
| 5,930,854 | A | 8/1999 | O'Neill et al. | |
| 5,937,461 | A | 8/1999 | Dombrowski et al. | |
| 5,984,791 | A | 11/1999 | Fair et al. | |
| 6,006,381 | A | 12/1999 | Tandrup | |
| 6,033,019 | A | 3/2000 | Hession-Kunz et al. | |
| 6,050,643 | A | 4/2000 | Kain et al. | |
| D424,312 | S | 5/2000 | Hotaling et al. | |
| 6,055,687 | A | 5/2000 | Matthews | |
| 6,061,854 | A | 5/2000 | Crowley | |
| 6,079,067 | A | 6/2000 | Becker et al. | |
| 6,079,772 | A | 6/2000 | Green | |
| 6,142,565 | A | 11/2000 | Rieder | |
| 6,161,896 | A * | 12/2000 | Johnson | B60R 7/043 297/188.08 |
| 6,233,767 | B1 | 5/2001 | Horowitz | |
| D443,461 | S | 6/2001 | Hall et al. | |
| D444,981 | S | 7/2001 | Hall et al. | |
| 6,279,185 | B1 | 8/2001 | Matthews | |
| D447,376 | S | 9/2001 | Kramer | |
| D450,517 | S | 11/2001 | Darling et al. | |
| 6,343,837 | B1 * | 2/2002 | Gage | A47C 4/52 297/170 |
| 6,354,665 | B1 | 3/2002 | Ross | |
| 6,390,345 | B1 | 5/2002 | Brown et al. | |
| 6,412,128 | B1 | 7/2002 | Matthews | |
| 6,434,770 | B2 | 8/2002 | Matthews Brown | |
| 6,463,608 | B1 | 10/2002 | Moe | |
| 6,467,840 | B1 | 10/2002 | Verbovszky et al. | |
| 6,484,337 | B1 | 11/2002 | Moe et al. | |
| 6,499,165 | B1 | 12/2002 | Morgillo | |
| 6,532,612 | B2 | 3/2003 | Matthews Brown | |
| 6,539,567 | B1 | 4/2003 | Bae | |
| 6,553,590 | B1 | 4/2003 | Leach | |
| 6,574,810 | B2 | 6/2003 | Mangiaracina | |
| 6,626,487 | B1 | 9/2003 | Buitendach | |
| 6,651,282 | B1 | 11/2003 | Skoug et al. | |
| 6,658,681 | B2 | 12/2003 | Britto et al. | |
| 6,666,505 | B2 | 12/2003 | Greger et al. | |
| 6,692,072 | B2 | 2/2004 | Nelson et al. | |
| 6,752,457 | B2 | 6/2004 | Gold et al. | |
| 6,773,064 | B2 | 8/2004 | Treen et al. | |
| 6,783,175 | B1 | 8/2004 | Henderson | |
| 6,810,545 | B1 | 11/2004 | Darling et al. | |
| 6,817,864 | B1 | 11/2004 | Martinez | |
| 6,877,176 | B2 | 4/2005 | Houghteling | |
| 6,918,149 | B2 | 7/2005 | Gowaty | |
| 6,918,631 | B2 | 7/2005 | Verbovszky | |
| 6,969,120 | B2 | 11/2005 | Levin | |
| 6,994,401 | B1 * | 2/2006 | Fischer | A47C 7/725 297/146 |
| 7,000,273 | B2 | 2/2006 | Rivera-Wienhold et al. | |
| 7,010,821 | B1 | 3/2006 | Leach | |
| 7,017,212 | B2 | 3/2006 | Matthews Brown | |
| 7,032,970 | B1 | 4/2006 | Kharat | |
| 7,044,547 | B2 | 5/2006 | Sorrenti | |
| 7,070,238 | B1 | 7/2006 | Alexander et al. | |
| 7,097,243 | B2 | 8/2006 | Verbovszky | |
| 7,104,603 | B2 | 9/2006 | Keegan et al. | |
| 7,131,156 | B1 | 11/2006 | Walker-Craft | |
| 7,201,445 | B1 | 4/2007 | Dubiel et al. | |
| D550,971 | S | 9/2007 | McConnell | |
| D553,865 | S | 10/2007 | Buitendach | |
| 7,300,103 | B1 * | 11/2007 | Grays | A47D 1/103 108/90 |
| 7,328,941 | B2 | 2/2008 | Asbach et al. | |
| 7,356,861 | B1 | 4/2008 | Pagano | |
| 7,364,235 | B2 | 4/2008 | Chen et al. | |
| 7,374,241 | B2 | 5/2008 | Gold et al. | |
| 7,387,337 | B2 | 6/2008 | Keegan et al. | |
| 7,416,257 | B1 | 8/2008 | Lakhman | |
| 7,422,276 | B2 | 9/2008 | Flannery | |
| 7,464,423 | B2 | 12/2008 | Goodwin et al. | |
| 7,497,518 | B2 | 3/2009 | Fritz et al. | |
| 7,513,001 | B1 | 4/2009 | Leach | |
| 7,562,406 | B1 | 7/2009 | Leach | |
| 7,562,938 | B2 | 7/2009 | Lakhman | |
| 7,571,961 | B2 | 8/2009 | Gold et al. | |
| 7,614,098 | B1 | 11/2009 | Quarry | |
| 7,614,930 | B2 | 11/2009 | Berkey et al. | |
| 7,641,283 | B2 | 1/2010 | Rumack | |
| 7,657,955 | B1 | 2/2010 | Alvistur et al. | |
| 7,673,940 | B2 | 3/2010 | Fritz et al. | |
| 7,673,942 | B2 | 3/2010 | Tuckey et al. | |
| 7,695,060 | B2 | 4/2010 | Dubiel et al. | |
| 7,798,571 | B2 * | 9/2010 | Billman | B60N 2/28 297/188.01 |
| 7,841,657 | B2 | 11/2010 | Nishimoto et al. | |
| 8,328,278 | B2 | 12/2012 | Rumack | |
| 8,408,650 | B2 | 4/2013 | Jacobs et al. | |
| 8,646,838 | B2 * | 2/2014 | Fiore, Jr. | A47D 1/004 297/250.1 |
| 8,651,572 | B2 | 2/2014 | Medeiros et al. | |
| 2008/0054696 | A1 | 3/2008 | McConnell et al. | |
| 2010/0052385 | A1 | 3/2010 | Martini | |
| 2010/0078976 | A1 | 4/2010 | Hou et al. | |
| 2011/0074187 | A1 * | 3/2011 | Zhong | A47D 1/006 297/130 |
| 2013/0057031 | A1 * | 3/2013 | Kummerfeld | A47D 1/008 297/174 R |

OTHER PUBLICATIONS

Bumbo; 1 pg.
Cozy Me; 1 pg.
Cuddle Seat; 1 pg.
Gel-tech; 1 pg.
Graco Blossom Booster Seat with Back Support Insert; 1 pg.
Hugga-Bebe; 1 pg.
J J Cole; 1 pg.
Keekaroo Infant Insert; 1 pg.
Kiddopotamus; 1 pg.
Leachco; 1 pg.
Positioning Pillow with Foam Blocks; 1 pg.
Prince Lionheart; 1 pg.
Snuggin' Go; 1 pg.
Summer Infant; 1 pg.
Summer Infant 3 Stage Super Seat; 1 pg.

* cited by examiner

BOOSTER SEAT WITH STOWABLE TRAY AND/OR STOWABLE SECURING STRAP

CROSS-REFERENCE TO RELATED APPLICATIONS

This application claims the priority benefit of U.S. Provisional Patent Application Ser. No. 61/845,426 filed Jul. 12, 2013, and U.S. Provisional Patent Application Ser. No. 61/834,487 filed Jun. 13, 2013, the entireties of which are hereby incorporated herein by reference for all purposes.

TECHNICAL FIELD

The present invention relates generally to booster seats for infants and other children, and more particularly to trays and securing straps for such booster seats.

BACKGROUND

Booster seats are commonly mounted onto the seats of highchairs to elevate infants and small children so they are able to sit at table height for mealtime. Typically, boosters seats can be used once a baby can sit upright unassisted, thereby enabling the infant to join the rest of the family at the table. This can be desirable because mealtime becomes more interactive and fun when parents can teach their small child to eat like the big kids side-by-side, and the little ones are proud to graduate to the big chair. In addition, such booster seats can also be used as TV chairs or for general seating purposes. And some booster seats are designed for use with child car safety seats and/or directly on the car seat itself.

Conventional booster seats sometimes include trays that mount in the front to provide a place for the child's food, drink, and/or toys. But when not in use these trays can be bulky and cumbersome, and for removable types they can become lost or damaged.

In addition, conventional booster seats sometimes include securing straps that mount the seat to a highchair and that secure the child in the seat. But when not in use these straps can be cumbersome and hazardous, and for removable straps they can become lost or damaged.

Accordingly, it can be seen that needs exist for improvements to booster seats to avoid the problems associated with loose trays and straps. It is to the provision of solutions to these and other problems that the present invention is primarily directed.

SUMMARY

Generally described, the present invention relates to a booster seat with innovative storage features. The booster seat can be of a conventional design for mounting onto an elevated surface such as a highchair, adult chair, bench, tabletop, or car seat, or for merely resting (unsecured) upon a non-elevated surface such as the floor. As such, the seat includes a base or bottom-support portion that supports the child in a sitting position.

In one aspect, the present invention relates to a storage compartment for a tray for holding the child's food, drink, and/or toys. The tray-storage compartment can be formed in the base of the seat and include an access opening through a sidewall of the base. The tray-storage compartment can include two opposite and inwardly-extending lips that support the tray in the stowed position, and a support foot that moves between a use position in the compartment where it helps support the seat and a stored position displaced from the compartment. Also, the tray-storage compartment can include ribs that engage the tray in the stowed position to retain it there.

In another aspect, the invention relates to a storage compartment for securing straps. The straps are provided for securing the seat to the support surface (e.g., a highchair) and are removable from the seat. The strap-storage compartment can be formed in the base and include an access opening with a closure for retaining the straps in the compartment.

These and other aspects, features, and advantages of the invention will be understood with reference to the drawing figures and detailed description herein, and will be realized by means of the various elements and combinations particularly pointed out in the appended claims. It is to be understood that both the foregoing summary and the following brief description of the drawings and detailed description of example embodiments are explanatory of particular example embodiments of the invention and are not restrictive of the invention, as claimed.

DETAILED DESCRIPTION OF EXAMPLE EMBODIMENTS

Figure 1:
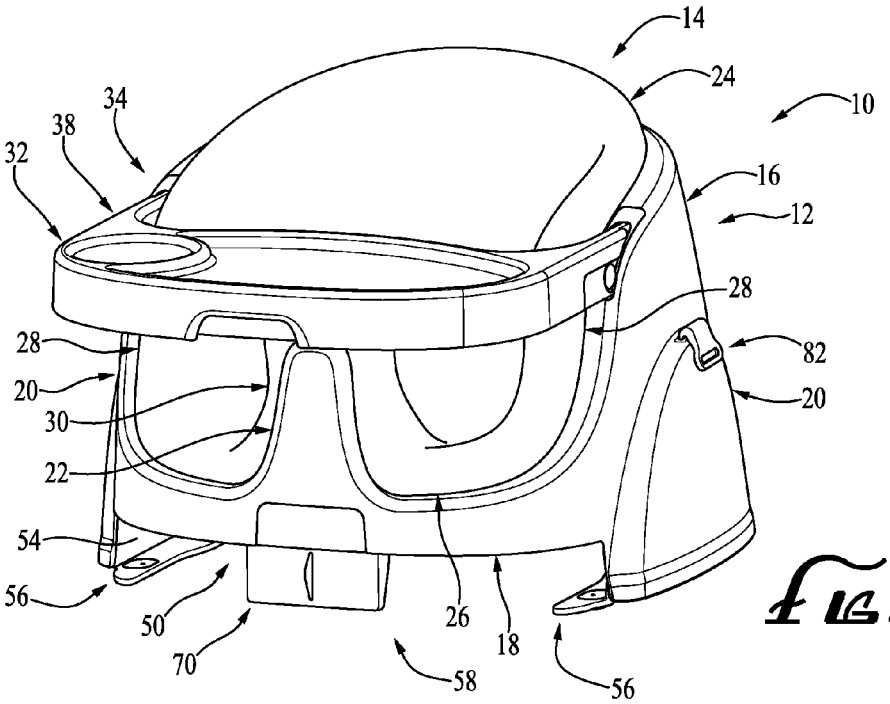
FIG. 1 is a perspective view of a booster seat according to an example embodiment of the present invention, showing its tray mounted in a use position.
Figure 2:
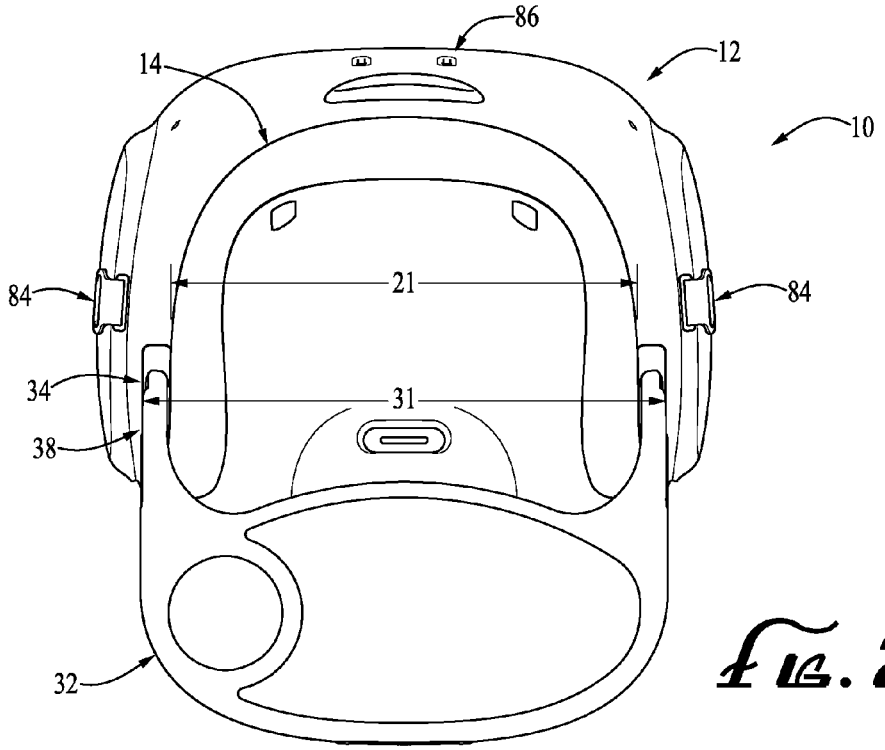
FIG. 2 is a top view of the booster seat of FIG. 1.

The present invention may be understood more readily by reference to the following detailed description of example embodiments taken in connection with the accompanying drawing figures, which form a part of this disclosure. It is to be understood that this invention is not limited to the specific devices, methods, conditions, or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" one particular value and/or to "about" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-9 show a booster seat 10 according to an example embodiment of the present invention. The basic design of the booster seat 10 can be of a conventional type well known in the art. As such, the booster seat 10 can be of a type for mounting onto an elevated surface such as a highchair, adult chair, bench, tabletop, or car seat, or for merely resting (unsecured) upon a non-elevated surface such as the floor.

For example, in the depicted embodiment the booster seat 10 includes a seat shell 12 and a seat insert 14 removably positioned within the seat shell. Typically, the seat shell 12 is made of a hard plastic material and the seat insert 14 is made of a cushioning soft plastic, though other embodiments are one-piece units (including for example two pieces that are not detachable), are made of other materials such as foam, graphite, fiberglass, metal, fabrics, and/or composites, and/or are not cushioned.

The seat shell 12 can include a backrest portion 16, a bottom-support portion 18, and two opposing sidewall portions 20, with the backrest and the sidewalls extending upward from the bottom support. Typically but not necessarily, the seat shell 12 can also include a horn 22 extending generally upward from a front portion of the bottom-support (i.e., base) portion 18 so that it is positioned between the legs of a child seated in the booster seat 10 to prevent the child from sliding downward and forward. The seat insert 14 can generally conform to the internal surfaces of the seat shell 12 so that it reduces the volume of the booster seat's seating area to accommodate smaller children and can be removed to accommodate larger children. As such, the seat insert 14 can include a backrest portion 24, a bottom-support portion 26, and two opposing sidewall portions 28. Typically but not necessarily, the seat insert can also include a horn 30. When referring to commonly-named components of the shell 12 and the insert 14, it will be understood that this is a reference to the shell, unless the context clearly dictates otherwise. And when referring to the seat 10 generally, it will be understood that this is not limited to a design with a discrete shell and insert, unless the context clearly dictates otherwise.

In addition, the booster seat 10 includes a tray 32 that removably attaches to the seat. The tray 32 can be of a conventional type well known in the art. The tray 32 is shown mounted in a conventional use position in FIGS. 1-2 and repositioned to an innovative stowed position in FIGS. 3-4. In the use position, the tray 32 can hold the child's food, drink bottles, toys, and/or other accessories in proximity to the seated child, and also aids in restraining the child in the seat 10. And in the stowed position, the tray 32 is removed from the use position and stored in the seat shell 12 so that it is out of the way and easily transported with the seat 10 without getting lost or damaged.

Referring additionally to FIGS. 5-8, the tray 32 removably mounts to the seat 10 (for example to the seat shell 12) by at least one and typically two releasable attachments 34 (one on each side of the seat). The releasable attachments 34 can be of a conventional type well known in the art. As such, the releasable attachments 34 can include mating male and female elements, push-pin mechanisms, bayonet fittings, clamps or clips, hooks and pins, or other mechanisms that permit ease, strength, and reliability in mounting and removing the tray 32 to the seat 10.

As just one example, each releasable attachment 34 can include a retractable male element 36 on one of the tray arms 38 and a female element 40 in one of the sidewall portions 20 of the seat shell 12 that releasably engages the male element. In the depicted embodiment, each male element 34 extends from a cantilevered arm 42 formed by one of the tray arms 38, with the arm including an actuator (e.g., a push button) 44, and with the arm in the form of a living hinge that is resiliently deflectable between a normal engaged position (see FIG. 7) and a retracted disengaged position (see FIG. 8). And each female element 40 is formed in a wall 46 defining a receptacle 48 that receives the respective tray arm 38 (see FIGS. 5 and 7).

So when the tray 32 is in the use position secured to the seat 10 and a caretaker decides to remove and stow the tray, the caretaker simply pushes in the actuators 44, thereby retracting the male elements 36 (from their normal engaged to their retracted disengaged positions) from engagement with the female elements 40 to release the tray from the seat, then pulls the tray linearly away from the seat until they are separated. And to mount the tray 32 onto the seat 10 in the use position, the caretaker merely inserts the tray arms 38 into the seat receptacles 48 until the male elements 36 deflect back to their normal engaged positions received in the female elements 40.

With the tray 32 removed from the seat 10, it can be stowed in an innovative way using the present invention.

Figure 20:
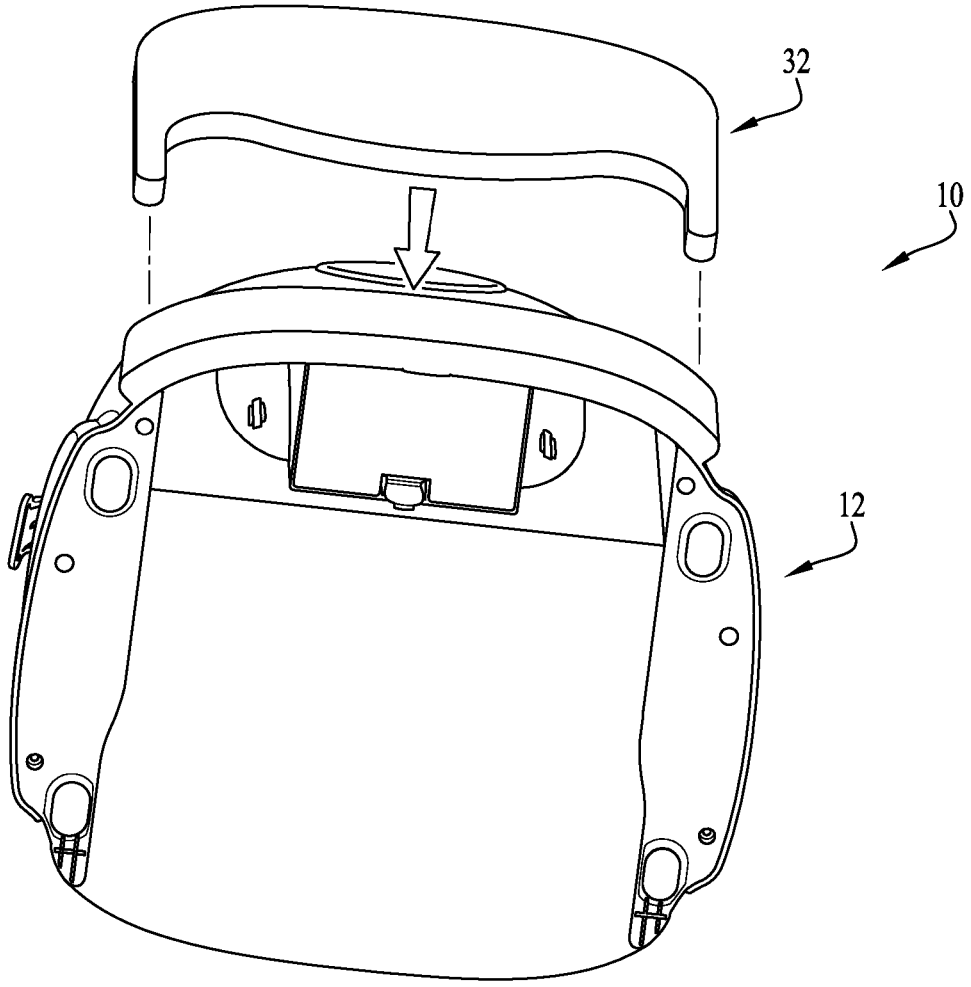
FIG. 20 is a bottom perspective view of a booster seat according to another example embodiment of the present invention, showing the tray being inserted into a storage compartment on the seat backrest.

Referring particularly to FIGS. 1, 3-4, and 20, the seat 10 includes a storage compartment 50 for the tray 32. The tray-storage compartment 50 can be formed anywhere in the seat 10, though typically it is formed in the seat shell 12, for example in the bottom-support 18 or the backrest 16, as shown in FIG. 20. The tray-storage compartment 50 is sized and shaped to receive substantially all of the tray 32 in the stowed position so that there are no (or substantially no) protruding portions of the tray extending laterally outward of the seat 10.

As just one example, the tray-storage compartment 50 can be formed in the bottom-support (i.e., base) portion 18 of the seat shell 12. In the depicted embodiment, the tray-storage compartment 50 has a top wall 52, two side walls 54, and two opposing lips 56 extending laterally inward toward each other and positioned below the top wall. As such, the base portion 18 between the inner edges of the two lips 56 defines a bottom opening 58 through which the tray-storage compartment 50 is in communication with the exterior of (the ambient space around) the seat 10. Typically, the lips 56 are at the bottom of the base 18 and the entire tray 32 slides into the compartment above and is supported atop the lips, though alternatively the lips can be elevated from the base bottom and the tray can include lateral grooves that slidingly receive the lips to support the tray in the compartment. The lips 56 each can be a contiguous shelf or ledge, or each can be formed by a series of tabs, fingers, or other inwardly extending structures. In any event, the lips 56 support the tray 32 when it is held in the tray-storage compartment 50 and the seat 10 is lifted off a supporting surface (e.g., a highchair), and they provide a low-profile and material-saving design. As such, the lips 56 typically have a thickness (height) that is less than the thickness of the tray.

In addition, the tray-storage compartment 50 includes an access opening 60 formed through the seat 10, for example in the front sidewall 19 (or another portion of a peripheral sidewall) of the base portion 18, through which the tray 32 can be inserted and withdraw. When viewed from the front, this front access opening 60 (and the compartment 50 recessed in the base 18) typically has a generally rectangular shape, or another shape conforming to the front-view shape of the tray 32. The seat 10 can include one or more mechanical stops 62 extending into the compartment 50 to act as mechanical stops for the tray 32 when it is inserted into the compartment, or a back wall 64 of the compartment can act as the mechanical stop, with the mechanical stop cooperating in defining the compartment.

Figure 3:
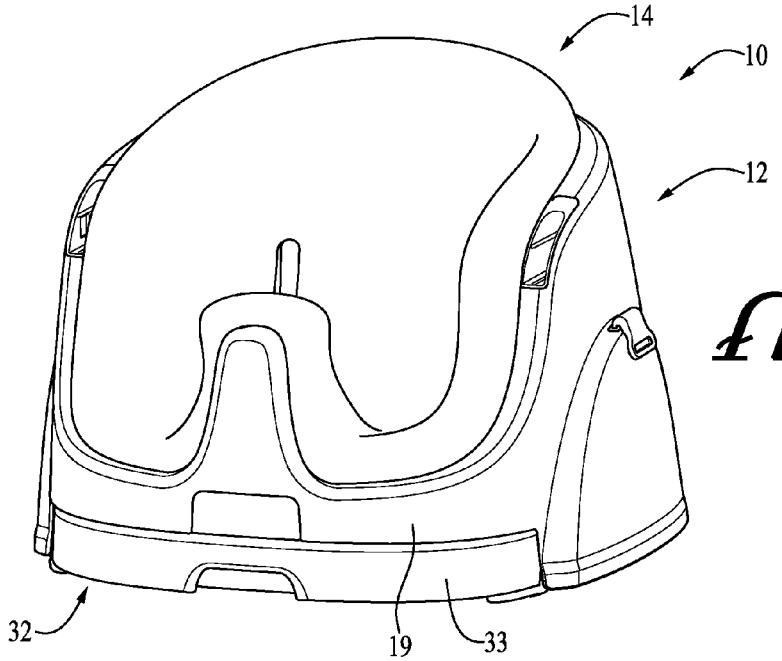
FIG. 3 shows the booster seat of FIG. 1 with the tray in a stowed position.
Figure 4:
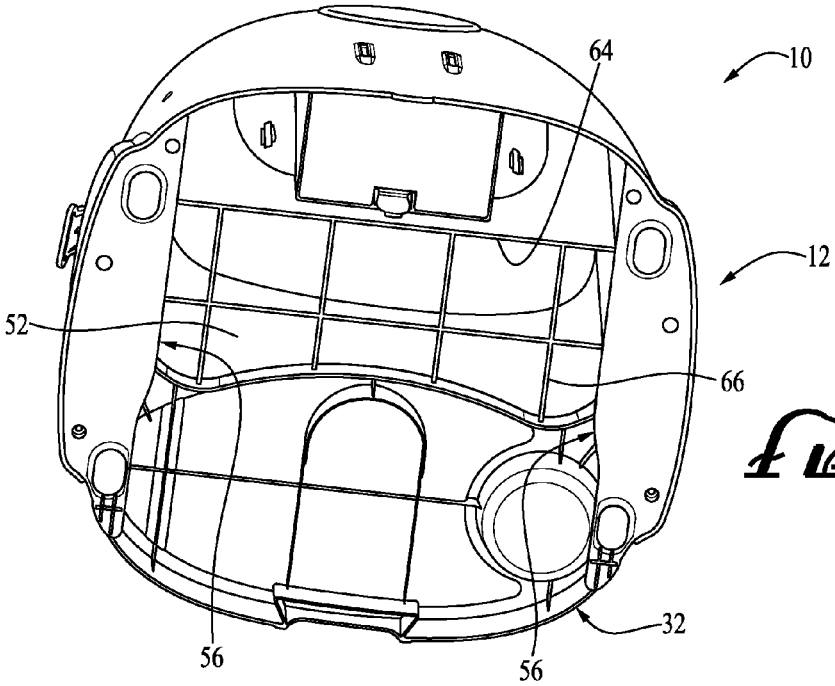
FIG. 4 is a bottom perspective view of the booster seat of FIG. 2.
Figure 5:
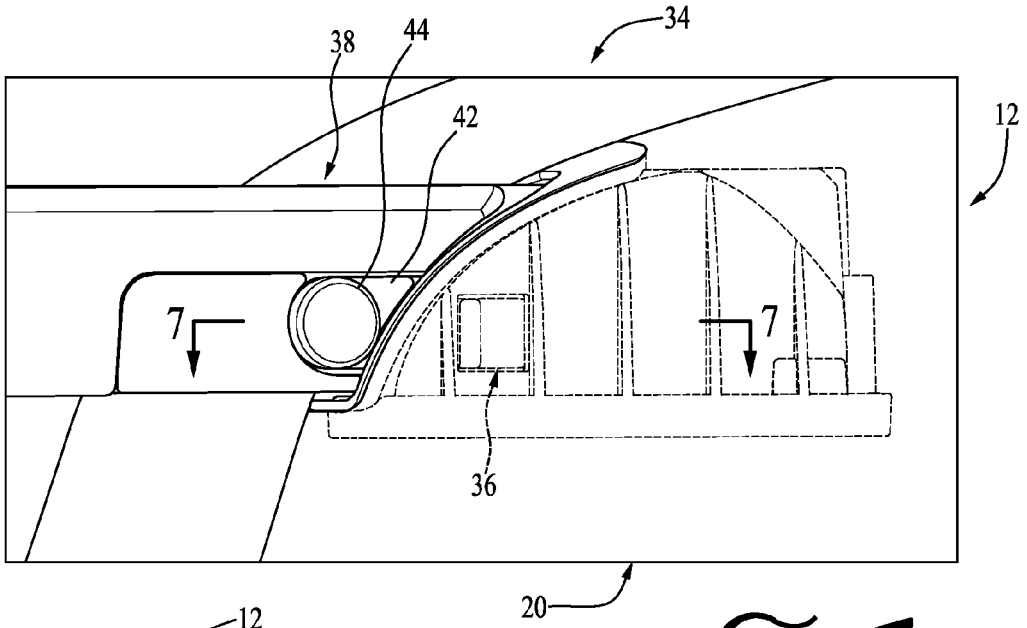
FIG. 5 is a perspective detail view of a portion of the booster seat of FIG. 1, showing a releasable attachment securing the tray to the seat in the use position.
Figure 6:
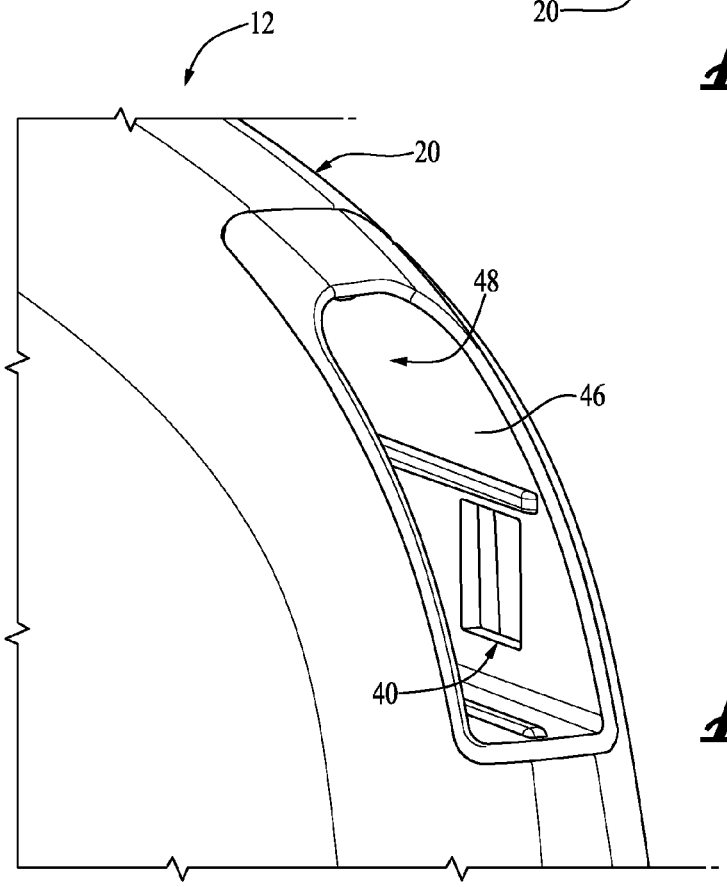
FIG. 6 is a perspective detail view of a portion of the releasable attachment of FIG. 5 with the tray removed from the seat for stowing.
Figure 7:
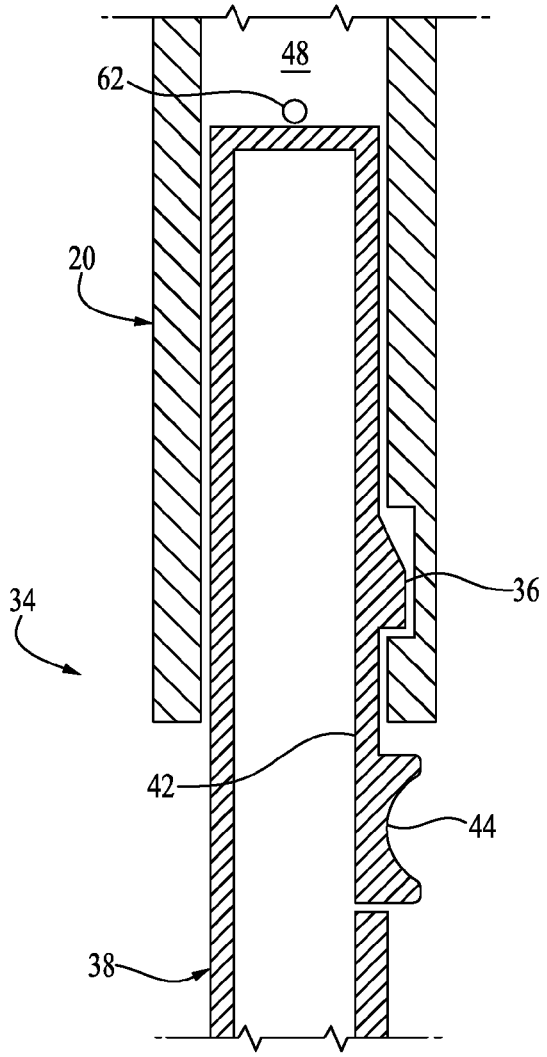
FIG. 7 is a cross-sectional detail view of the releasable attachment taken at line 7-7 of FIG. 5 with the tray secured to the seat in the use position.
Figure 8:
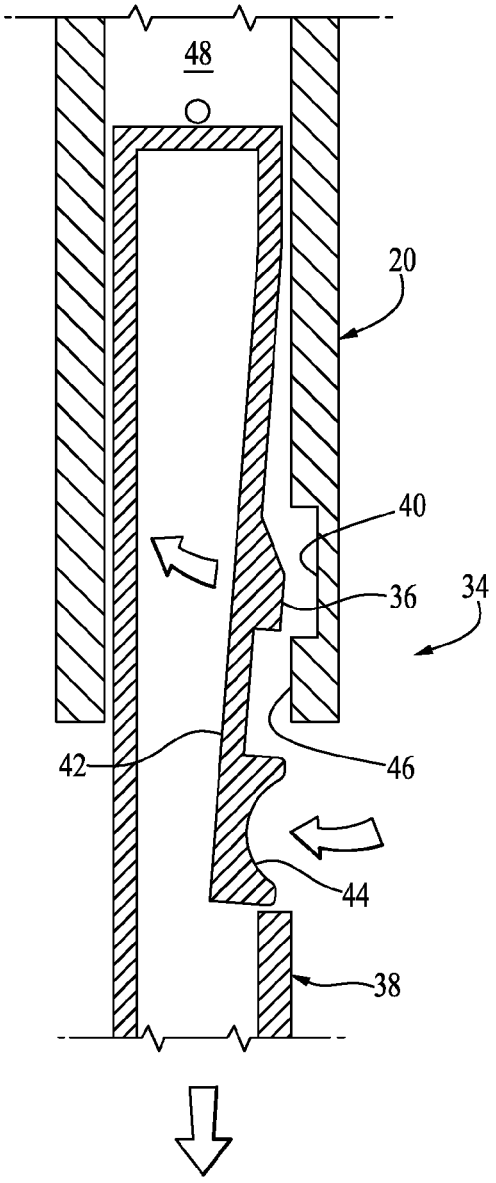
FIG. 8 shows the releasable attachment of FIG. 7 actuated to release the tray so it can be removed from the seat and stowed.
Figure 9:
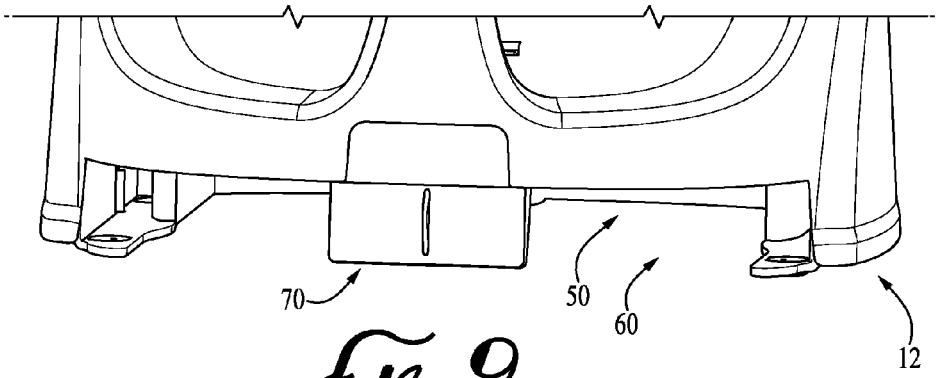
FIG. 9 is a front perspective detail view of a portion of the booster seat of FIG. 1, showing a retractable support foot in the use position.
Figure 10:
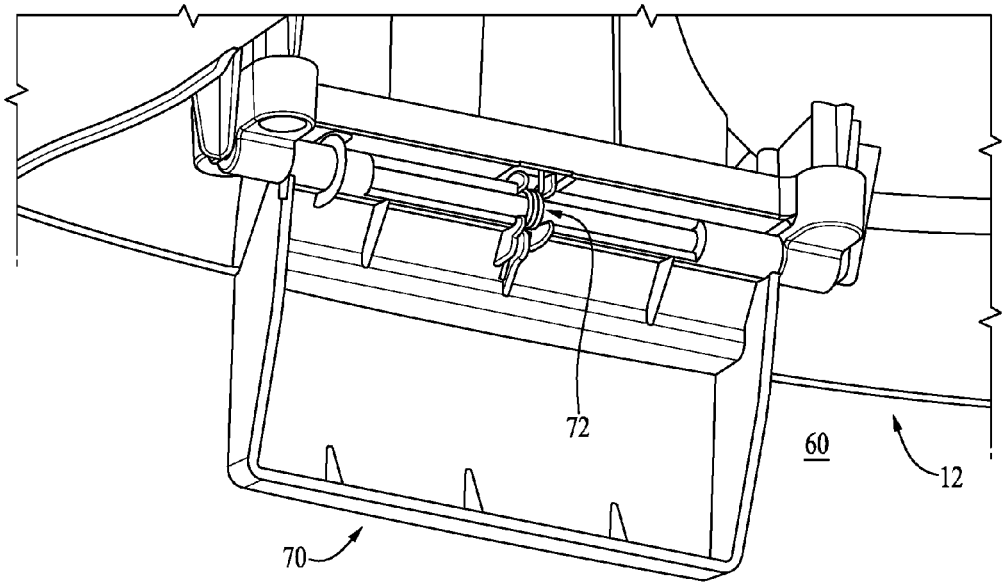
FIG. 10 is a rear perspective detail view of the booster-seat portion of FIG. 9.
Figure 13:
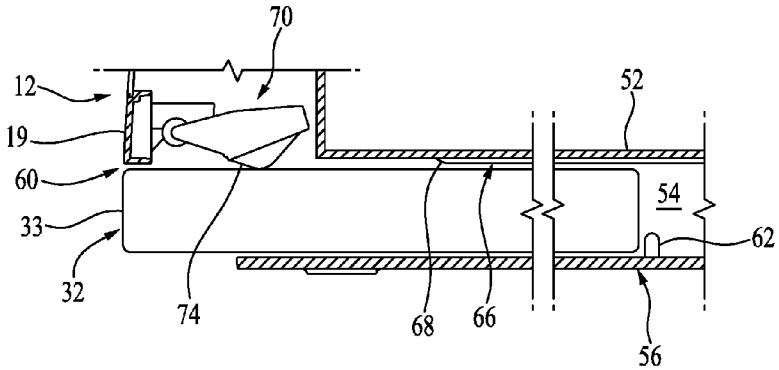
FIG. 13 is a right-side cross-sectional detail view of the booster-seat portion of FIG. 12 with the tray fully inserted into the storage compartment in a stowed position and the support foot fully retracted into the stowed position.
Figure 14:
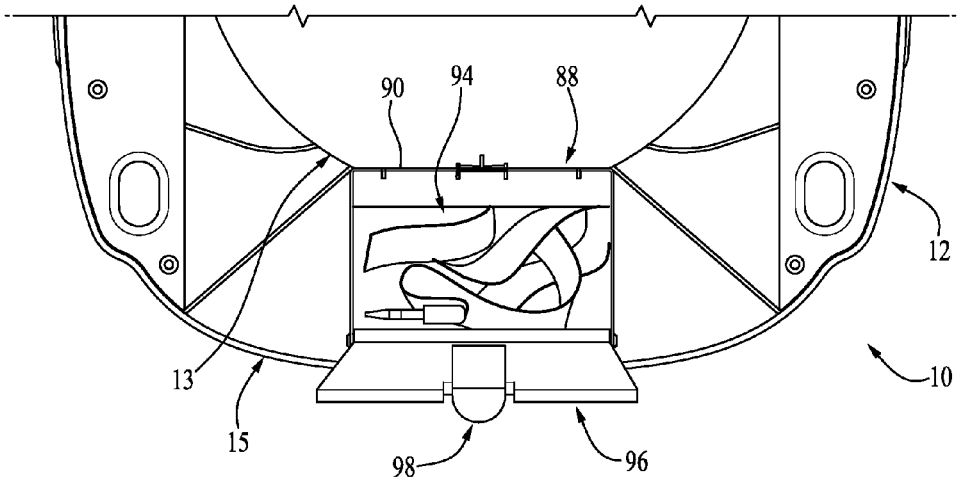
FIG. 14 is a bottom perspective detail view of a portion of the booster-seat of FIG. 1, showing a storage compartment with its cover in an open position revealing securing straps held therein in a stowed position.
Figure 15:
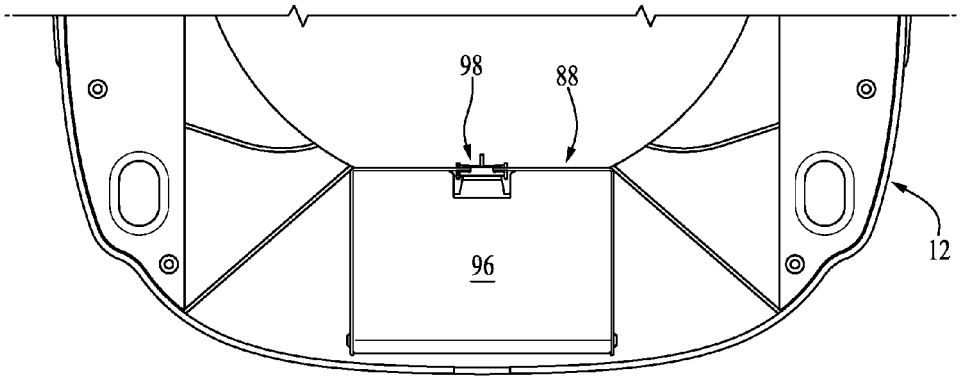
FIG. 15 shows the storage compartment of the booster-seat of FIG. 14 with the cover in a closed position.
Figure 16:
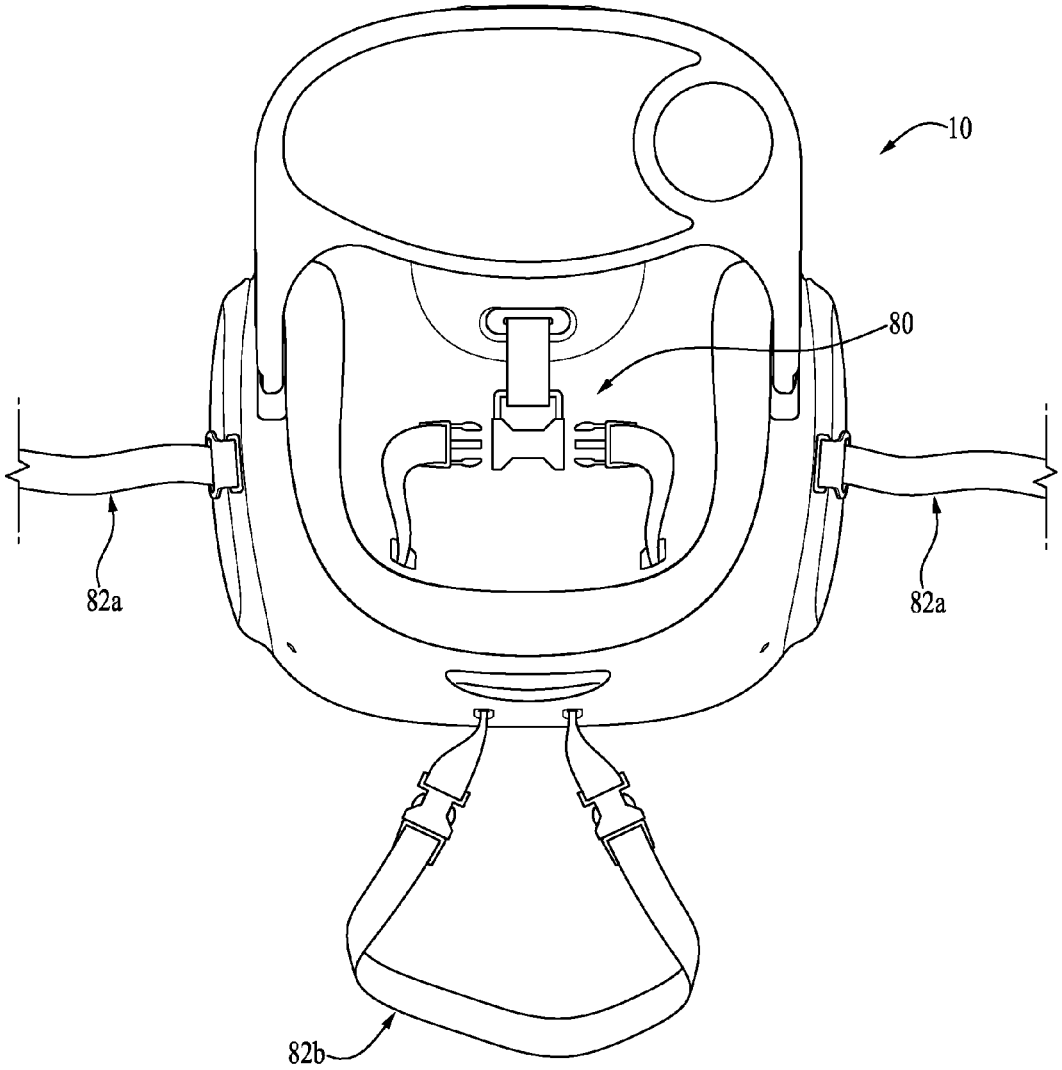
FIG. 16 is a top view of the booster-seat of FIG. 1, showing the securing straps removed from the storage compartment.
Figure 17:
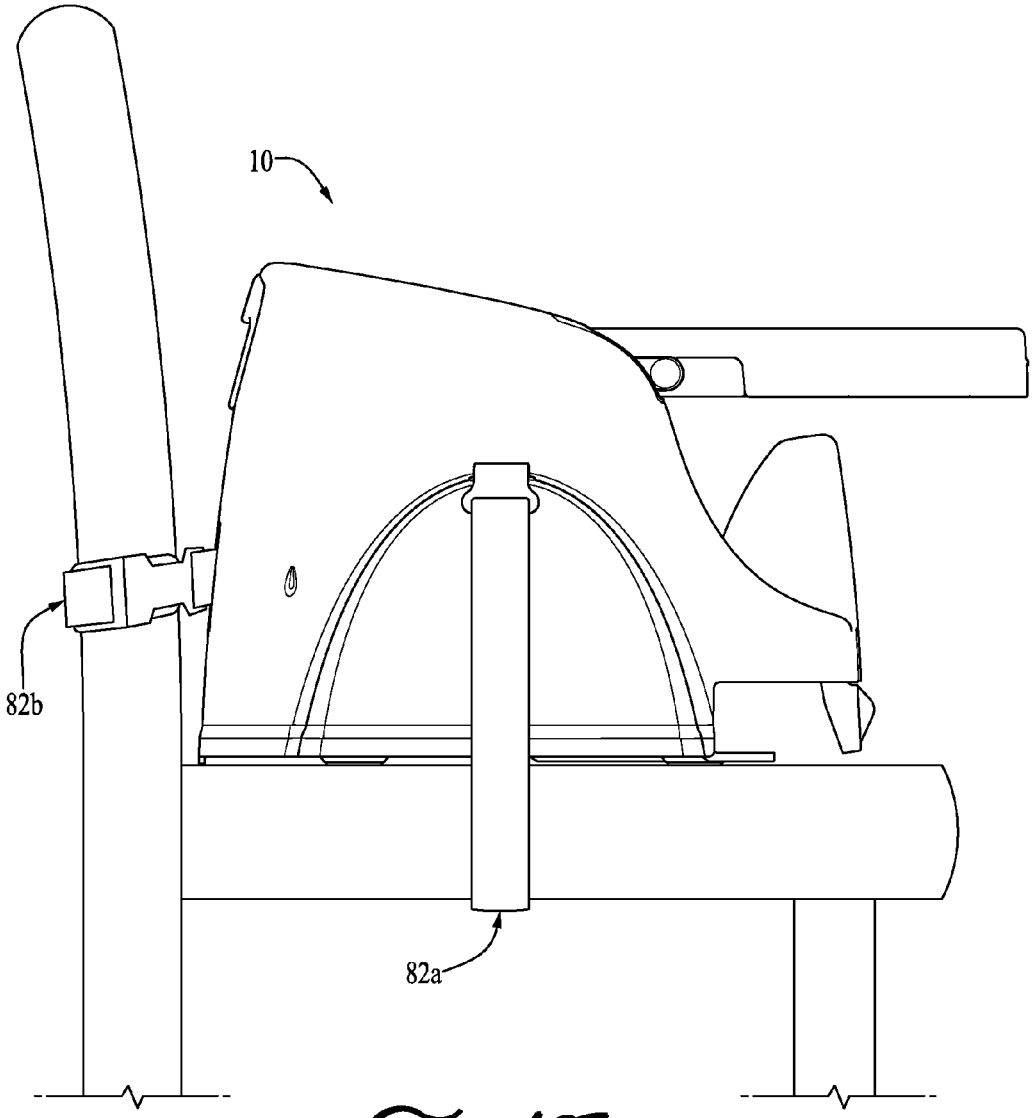
FIG. 17 is a side view of the booster-seat of FIG. 16, showing the securing straps in a use position securing the seat to a chair.
Figure 18:
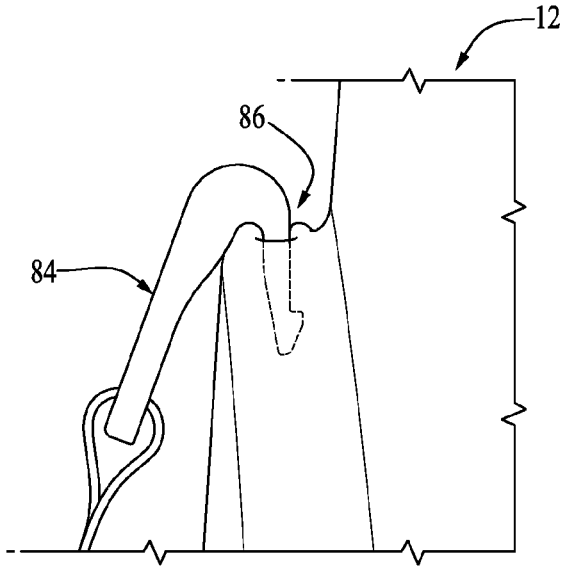
FIG. 18 is a side detail view of a portion of the booster-seat of FIG. 17, showing one of the securing straps mounted to the seat in the use position.
Figure 19:
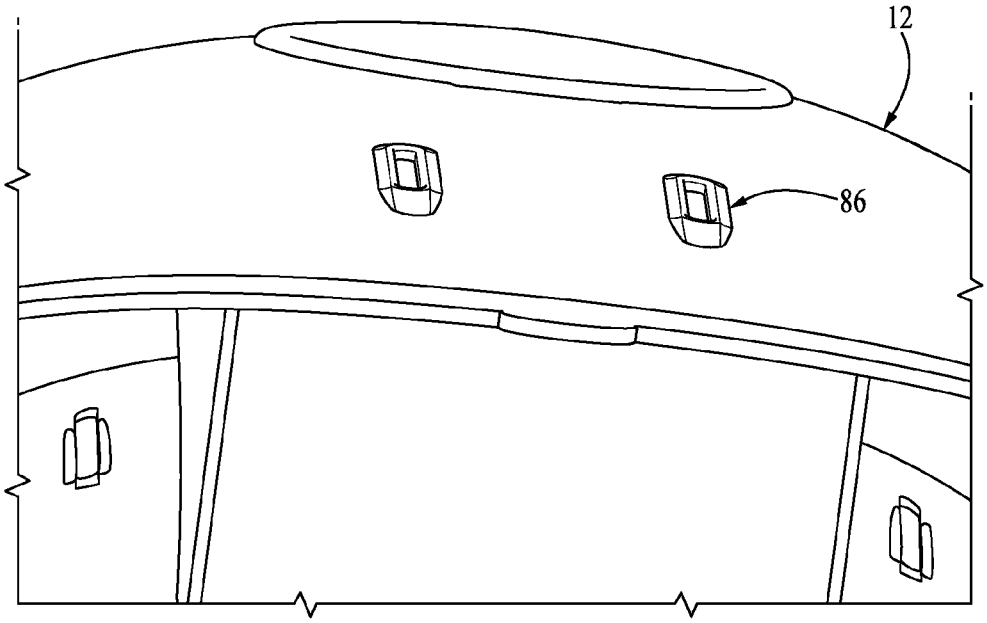
FIG. 19 is a rear bottom perspective view of the booster-seat of FIG. 17, showing two of the female attachments for receiving the securing straps.

With the compartment 50 sized and shaped to receive substantially all of the tray 32 in the stowed position, in typical embodiments the front edge 33 of the tray is generally flush with the front surface 19 of the base portion 18 of the seat 10 (see FIGS. 3 and 13). The width 51 of the compartment 50 (between the side walls 54) is greater than the width 31 of the tray 32, which is typically (for trays that extend across and attach to the seat on both sides) greater than the width 21 of the sitting well between the sidewall portions 20 (see FIGS. 3 and 13), where the sitting well is formed by the base 18 and the upwardly extending backrest 16 and sidewalls. And the height of the compartment 50 (between the lips 56 and the top wall 52) is greater than the height of the base portion 18. (In embodiments without the ribs described below, the height of the compartment can be substantially equal to, including slightly less than, the height of the base portion to cause a slight deflection of the lips thereby producing a nominal frictional holding force on the tray (as described below when describing the ribs).

To help hold the tray 32 in the compartment 50, one or more ribs 66 extend downward into the compartment from the top wall 52 to contact the tray and apply a nominal frictional force to retain the tray in the compartment. In typical embodiments, the lips 56 are capable of slight deflection downward (i.e., outward from the compartment) to contact the tray and apply a nominal frictional force to retain the tray in the compartment. The ribs 66 can have a front end 68 positioned not at the front of the compartment 50 at the access opening 60 (and thus not at the front surface 19 of the base portion 18 of the seat 10), but instead inward from there and still within the compartment (i.e., there is a rib-less gap between the access opening and the rib front end) so that the tray 32 is partially inserted into the compartment before it engages the ribs. In this way, the tray 32 can be easily slid partially into the compartment 50 until it engages the ribs 66, and then as it is slid farther into the compartment the lips 56 deflect slightly downward/outward and/or the ribs deflect slightly upward/outward to permit smooth sliding but at the same time provide a nominal frictional force that is sufficient to keep the tray 32 from sliding out of the compartment 50 by gravity if the seat 10 is held with the access opening facing downward and jostled. As such, the distance between the ribs 66 and the lips 56 is about the same or less than the height 35 of the tray 32. In other embodiments, the ribs extend upward from the lips or from a bottom wall of the compartment, or other tray-retention elements are provided such as magnets or clips.

Furthermore, a retractable support foot 70 can be provided to assist in proper support of the seat 10. The retractable support foot 70 extends down into the compartment 50 with its bottom 71 in the horizontal plane of the bottom surface 17 of the base 18 (e.g., the bottom surface of the lips 56) when in the deployed position for assisting in supporting the seat 10 and in a retracted position is moved out of the compartment 50 to provide clearance for the tray 32 to be inserted into the compartment in the stowed position. This feature is particularly, but not only, advantageous in embodiments such as that depicted with the bottom opening 58 formed between the lips 56.

Figure 11:
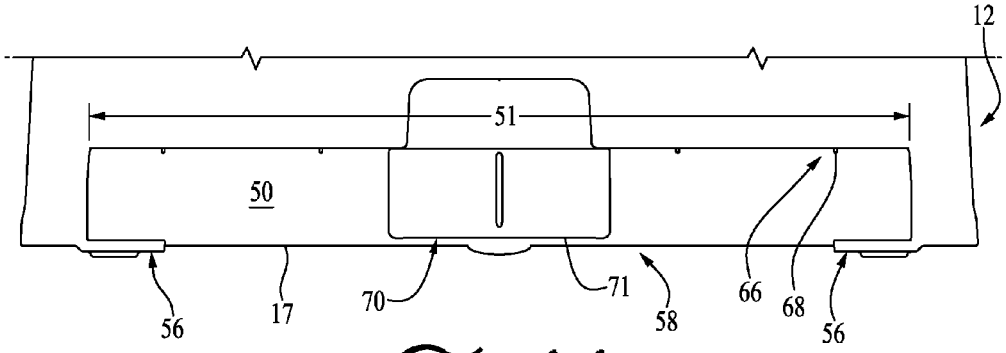
FIG. 11 is a front-side detail view of the booster-seat portion of FIG. 9.
Figure 12:
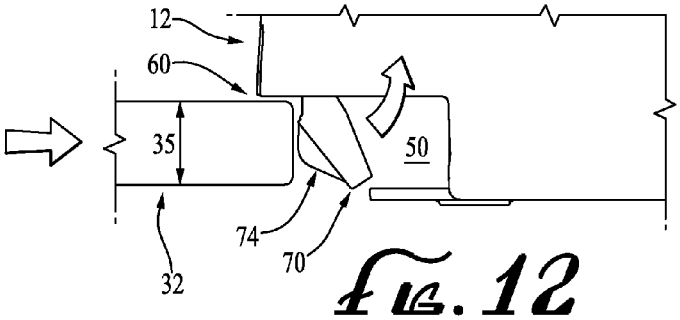
FIG. 12 is a right-side detail view of the booster-seat portion of FIG. 11, showing the removed tray being inserted into a storage compartment and pushing/retracting the support foot from the use position.

In the depicted embodiment, for example, the support foot 70 is in the form of a panel that is positioned at the front 19 of the seat 10 at the front access opening 60 for peripheral support when in the deployed position (see FIG. 11), that is biased by a spring 72 toward the deployed position, and that pivots inward and upward to a retracted position (see FIG. 12). An actuating head 74 can extend forward from the support foot 70 and be contacted by the tray 32 upon insertion into the compartment 50 to displace (e.g., push) the foot to the retracted position out of the compartment. In other embodiments, the support foot extends upward from the lips, or is provided by one or more pins, tabs, or other support-column structures.

In some embodiments, the tray-storage compartment is formed as a five-sided enclosure in the seat with an access opening, with no bottom lips or opening (with instead a bottom wall provided), thus effectively defining a slot or channel. In embodiments with an access opening through which the tray is inserted and withdrawn, the seat can include a closable door (e.g., a panel, grate, arm, finger, bar, or frame) that moves (e.g., pivots or slides) between open and closed positions to access the compartment.

In other embodiments, the access opening in the seat through which the tray is inserted into and removed from the tray-storage compartment is formed in the backrest or one of the sidewalls of the seat shell. In still other embodiments, the seat does not include an access opening and instead the tray is inserted into and removed from the tray-storage compartment vertically (e.g., by stacking the seat upon the tray) by the lips being repositionable (e.g., horizontally pivotal or slidable) between access and retaining positions or by the lips providing a snap-fit connection with the base.

Referring now particularly to FIGS. 14-19, the booster seat 10 can include an innovative way to store its securing straps when not in use. The securing straps can be of a conventional type for mounting onto an elevated surface such as a highchair, adult chair, bench, tabletop, or car seat. As such, the securing straps are typically provided by flexible webbing (or belts or cords), and they typically include buckles for length-adjustment, though they can be provided in other forms such as clips (to clamp the booster seat to the support surface) or other conventional retaining devices.

In the depicted embodiment, for example, there are provided three sets of securing straps, including child-securing straps 80 to secure a child in the seat 10, as well as seat-securing straps 82*a* to mount the seat to a horizontal seat surface (e.g., the seat of a highchair) and seat-securing straps 82*b* to mount the seat to an upright surface (e.g., the backrest of a highchair). In other embodiments, more or fewer sets of securing straps are provided for these or other securing functionalities.

The seat-securing straps 82*a-b* detachably couple to the seat 10 so that they can be mounted to the seat for use and detached when not in use. For example, the straps 82*a-b* (collectively, "the straps 82") can include male attachments (e.g., the depicted hooks 84, or clips, snaps, or ties) at their opposing ends that are removably received in female attachments (e.g., the depicted slots 86, or recesses, openings, or notches) in the seat 10. In other embodiments, other types of conventional detachable couplings, such as latches, buckles, clamps, snaps, ties, or the like, are provided for the straps and the seat. In some embodiments, the child-securing straps 80 are fixedly mounted to the seat 10, and in other embodiments they are also detachable and can be stowed with the seat-securing straps 82.

The seat includes an innovative strap-storage compartment 88 that receives and stores the straps 82 in a stowed position after they are detached from the booster seat 10. In this way, the straps 82 (including their hooks 84) can be secured and stored out of the way so they are not loose and dangling when transporting or storing the seat 10. The compartment 88 can be located in the base 18, or alternatively in the backrest 16 or another portion of the seat 10.

In the depicted embodiment, for example, the strap-storage compartment 88 includes a peripheral sidewall 90 surrounding an access opening 94, an end wall (not shown) opposite the access opening, and a closure 96 for the access opening. The peripheral sidewall 90 can be provided by four walls forming a rectangular area, as depicted. The sidewall 90 can be generally vertical, with two opposing portions formed by the back wall 15 of the base 18 and by the back wall 13 of the sitting well (formed between the sidewall portions 20). And the access opening 94 can face downward (in use) so that the compartment 88 can be accessed to stow and retrieve the straps 82 by lifting the seat 10 and turning it over. Alternatively, the access opening can extend through a sidewall of the base (or other portion of the seat) and face laterally outward so the straps can be stowed without inverting the seat. Typically, the compartment 88 is recessed into the seat 10 so that it does not protrude from the seat, with the closure 96 recessed so that it does not rest on the support surface in use.

The closure 96 can be provided by a flat panel, as depicted. Alternatively, it can be provided by a grate, a screen, a plurality of bars, or another structure that moves between an open position providing access to the compartment 88 and a closed position retaining the straps 82 in the compartment. The closure 96 can move between the open and closed positions by pivoting about a hinge, or it can slide, be completely removable, or otherwise move between the open and closed positions. A releasable coupling 98 is provided for retaining the closure 96 in the closed position. The releasable coupling 98 can be provided by a conventional assembly such as a living-hinge snap-fit coupling (as depicted), a strap with a snap, or the like.

In other embodiments, the straps are permanently affixed to the seat at fixed ends of the straps. In some such embodiments, the strap fixed ends are permanently attached to the seat at or within the compartment, and substantially all of the lengths of the straps are stored within the compartment. The straps in such embodiments can be routed from the compartment and removably received through other portions of the seat (e.g., through open-ended slots, hooks, or clips at the sidewalls of the seat for securing to a horizontal surface i.e., a chair seat). And in some other such embodiments, the strap fixed ends are permanently attached to the seat at locations away from the compartment, and only portions of the lengths of the straps (e.g., the free ends opposite the fixed ends) are stored within the compartment.

While the invention has been described with reference to preferred and example embodiments, it will be understood by those skilled in the art that a variety of modifications, additions and deletions are within the scope of the invention, as defined by the following claims.

What is claimed is:

1. A booster seat for a child, comprising:

a seat on which the child sits and is supported;

a tray that removably attaches to the seat and is repositionable between a use position mounted to the seat and a stowed position, wherein the tray has a width and a height; and a storage compartment formed in the seat, wherein the tray is received in the storage compartment in the stowed position, wherein the storage compartment has a width and a height, the storage compartment width is greater than the tray width, and the storage compartment height is substantially equal to or greater than the tray height, wherein the storage compartment is defined at least in part by a top wall and two inwardly extending and opposing lips positioned below the top wall, wherein the lips define therebetween a bottom opening of the compartment, and wherein the lips support the tray in the stowed position.

2. The booster seat of claim 1, wherein the seat includes a base and includes a backrest and two opposing sidewalls extending upward therefrom, wherein the base, the backrest, and the sidewalls form a sitting well in which the child sits and having a width between the sidewalls, and wherein the storage compartment width and the tray width are greater than the sitting well width.

3. The booster seat of claim 1, wherein the seat includes a base upon which the child sits, wherein the storage compartment is formed in the base.

4. The booster seat of claim 3, wherein the base includes at least one sidewall, the storage compartment includes an access opening formed in the sidewall, and the tray is inserted into and withdrawn from the compartment through the access opening.

5. The booster seat of claim 1, further comprising a retractable support foot that moves between a deployed position and a retracted position, wherein in the deployed position the foot extends into the compartment and a bottom of the foot is in a horizontal plane of a bottom surface of the base to help support the seat, and in the retracted position the foot is displaced from the compartment to provide clearance for the tray to be inserted into the compartment in the stowed position.

6. The booster seat of claim 5, wherein the support foot is spring-biased toward the deployed position and moved from the deployed position toward the retracted position upon contact with and displacement by the tray being inserted into the stowed position in the compartment.

7. The booster seat of claim 1, wherein the lips are positioned at a bottom of the base and the tray in its entirety slides into the compartment above the lips and is supported atop the lips.

8. The booster seat of claim 1, wherein the lips deflect downward upon being contacted and displaced by the tray as the tray is slid into the compartment toward the stowed position, the deflection generating a nominal frictional force that retains the tray in the compartment.

9. The booster seat of claim 1, further comprising at least one rib extending into the compartment and engaging the tray in the stowed position in the compartment to apply a nominal frictional force to retain the tray in the compartment.

10. The booster seat of claim 9, wherein the rib includes a front end positioned within the compartment inward from an access opening of the compartment so that the tray does not engage the rib front end until at least partially inserted into the compartment.

11. A booster seat for a child, comprising:

a seat on which the child sits and is supported, wherein the seat includes a base with two opposing sidewalls extending upward therefrom and includes a backrest, wherein the base, the backrest, and the sidewalls form a sitting well in which the child sits and having a width between the sidewalls, and wherein the base includes at least one base wall;

a tray that removably attaches to the seat and is repositionable between a use position mounted to the seat and a stowed position, wherein the tray has a width and a height;

a storage compartment formed in the base of the seat, wherein the tray is received in the storage compartment in the stowed position, wherein the storage compartment has a width and a height, the storage compartment width is greater than the tray width which in turn is greater than the sitting well width, and the storage compartment height is substantially equal to or greater than the tray height, wherein the storage compartment includes an access opening formed in the wall of the base, and the tray is inserted into and withdrawn from the compartment through the access opening; and a retractable support foot that moves between a deployed position and a retractable position, wherein in the deployed position the foot extends into the compartment and a bottom of the foot is in a horizontal plane of a bottom surface of the base to help support the seat, and in the retracted position the foot is displaced from the compartment to provide clearance for the tray to be inserted into the compartment in the stowed position.

12. The booster seat of claim 11, wherein the support foot is spring-biased toward the deployed position and moved from the deployed position toward the retracted position upon contact with and displacement by the tray being inserted into the compartment toward the stowed position.

13. The booster seat of claim 11, wherein the storage compartment is defined at least in part by a top wall and two inwardly extending and opposing lips positioned below the top wall, wherein the lips define therebetween a bottom opening of the compartment, and wherein the lips support the tray in the stowed position.

14. The booster seat of claim 13, wherein the lips deflect downward upon being contacted and displaced by the tray as the tray is slid into the compartment toward the stowed position, the deflection generating a nominal frictional force that retains the tray in the compartment.

15. The booster seat of claim 11, further comprising at least one rib extending into the compartment and engaging the tray in the stowed position in the compartment to apply a nominal frictional force to retain the tray in the compartment.

16. The booster seat of claim 15, wherein the rib includes a front end positioned within the compartment inward from the access opening of the compartment so that the tray does not engage the rib front end until at least partially inserted into the compartment.

17. A booster seat for securing to a surface and supporting a child, comprising:

a seat in which the child sits and is supported;

a tray that removably attaches to the seat and is repositionable between a use position mounted to the seat and a stowed position;

a tray storage compartment formed in the seat, wherein the tray is received in the storage compartment in the stowed position;

one or more securing straps for securing the booster seat to the surface; and a strap storage compartment formed by the seat, separate from the tray storage compartment, wherein at least a portion of the straps can be stored out of the way in the compartment so they are not loose and dangling when transporting or storing the seat; wherein:

the straps are detachably coupled to the seat;

the straps secure the seat to a vertical portion of the surface, a horizontal portion of the surface, or both;

the strap storage compartment includes an access opening and a closure that is repositionable between an open position in which the straps can be inserted into the strap storage compartment and a closed position in which the straps are retained in the strap storage compartment;

the strap storage compartment is formed in a base of the seat;

the access opening faces downward;

the strap storage compartment includes a peripheral sidewall surrounding the access opening;

a portion of the peripheral sidewall is formed by a back wall of the base; and an opposing portion of the peripheral sidewall is formed by a back wall of a sitting well formed in part by the base.

18. The booster seat of claim 17, wherein the straps can be removed from the seat and then secured and stored out of the way entirely within the strap storage compartment.

* * * * *